US005168582A

United States Patent [19]

Aldridge

[11] Patent Number: 5,168,582

[45] Date of Patent: Dec. 8, 1992

[54] FIREFIGHTER TURNOUT PANTS SUSPENDER SUPPORT ARRANGEMENT

[75] Inventor: Donald Aldridge, New Carlisle, Ohio

[73] Assignee: Lion Apparel, Inc., Dayton, Ohio

[21] Appl. No.: 688,242

[22] Filed: Apr. 22, 1991

[51] Int. Cl.[5] ..... A41F 11/14; A41D 27/04

[52] U.S. Cl. ..... 2/305; 2/79; 2/227; 2/229; 2/230; 2/300; 2/304; 2/307

[58] Field of Search ..... 2/79, 227, 229, 230, 2/231, 300, 304, 305, 307, 308, 310, 311, 312, 314, 315, 316, 317, 318, 320, 323, 326

[56] References Cited

U.S. PATENT DOCUMENTS

| | | | |
|---|---|---|---|
| 287,020 | 10/1883 | Greely | 2/326 |
| 372,051 | 10/1887 | Truax | 2/326 |
| 533,373 | 1/1895 | Presby | 2/230 X |
| 542,891 | 7/1895 | Hoyt | 2/310 |
| 713,106 | 11/1902 | Jones | 2/310 |
| 1,271,248 | 7/1918 | Walcoff | 2/227 |
| 1,584,765 | 5/1926 | Gillette | 2/229 |
| 2,274,270 | 2/1942 | Kalb | 2/227 |
| 3,127,896 | 4/1964 | Puliafico | 2/227 X |
| 3,579,639 | 5/1971 | Faulkner | 2/326 X |
| 4,253,197 | 3/1981 | Posta | 2/227 X |
| 4,282,608 | 8/1981 | Amberg | 2/227 |
| 4,481,682 | 11/1984 | Hau | 2/304 X |
| 4,561,121 | 12/1985 | Ehrung et al. | 2/227 X |
| 4,787,101 | 11/1988 | Feinberg | 2/105 |

FOREIGN PATENT DOCUMENTS

| | | | |
|---|---|---|---|
| 322221 | 6/1957 | Switzerland | 2/230 |

*Primary Examiner*—Andrew M. Falik
*Assistant Examiner*—Jeanette E. Chapman
*Attorney, Agent, or Firm*—Killworth, Gottman, Hagan & Schaeff

[57] ABSTRACT

An improved suspender support arrangement for firefighter's trousers provides more even support for the inner liner and the outer shell of turnout pants. First fasteners, buttons or studs in two illustrated embodiments, are secured to the waist area of the inner liner of the turnout pants for receiving loop fasteners of a set of suspenders. Second fasteners, buttons or sockets in the two illustrated embodiments, are secured to the waist area of the outer shell of the turnout pants at a plurality of locations therearound. The second fasteners are aligned with and receive the first fasteners such that the set of suspenders supports both the inner liner and the outer shell of the turnout pants. In a third embodiment, suspenders are affixed to the inner liner which is in turn removably attached to the outer shell. The apparatus ensures that the turnout pants include an inner liner since the set of suspenders cannot be secured to the turnout pants without an inner liner.

19 Claims, 2 Drawing Sheets

FIREFIGHTER TURNOUT PANTS SUSPENDER SUPPORT ARRANGEMENT

BACKGROUND OF THE INVENTION

The present invention relates generally to protective clothing for firefighters and, more particularly, to a suspender support arrangement for firefighters turnout pants wherein suspenders are initially coupled to an inner liner with an outer shell of the turnout pants then being coupled to the inner liner.

Firefighting is very physically demanding work which must be performed under stressful conditions even in the best of circumstances. It is essential for firefighters to wear clothing which protects them from the hazards of the fire environment, while still providing comfort and preventing unnecessary distraction from their work. Firefighter's apparel most often consists of a long-sleeve turnout coat, protective gloves, full length turnout pants, and boots. Firefighter's apparel customarily has a plurality of layers with each layer being formed of a material different from the materials of the other layers, and each layer serving a purpose different from the purpose of the other layers.

A firefighter's turnout pants and coat typically have an inner liner which provides the requisite thermal barrier for firefighting apparel and an outer shell which is fire and abrasion resistant. While the inner liner and outer shell of the garments are attached together as a unit for fire fighting, the inner liner is removable from the firefighting garment such that the garment can be cleaned and dried more effectively and quickly. However, removing the inner liner makes the garment unacceptable for firefighting protection. Accordingly, it is possible either intentionally for a cooler garment or inadvertently, to don firefighter's apparel which does not include the inner liner.

This problem has been addressed in regard to turnout coats by means of "liner-out" indicators. For example, U.S. Pat. No. 4,507,806 discloses a protective turnout coat for firefighters having an outer protective shell and an inner liner with a collar. The outer protective shell is secured to the inner liner proximate to the inner liner collar by fastening means such that the observance of the collar is indicative of the presence of the inner liner. In another example, U.S. Pat. No. 4,774,725 discloses a firefighter's turnout coat having an outer shell and inner liner which is removably attachable to the inside of the shell. The outer shell includes a slit with a strip of reflective material attached to its outer surface near the slit. The inner liner includes a flap which fits through the slit and covers the reflective strip such that an observer may visually determine whether or not the inner liner is present inside the outer shell.

These examples are representative of firefighter's coats which include visual indications of whether an inner liner is properly attached. However, applicant is unaware of any "liner-out" indicators in the art for firefighter's trousers and suspender apparel even though they are subject to similar problems vis-a-vis use of the apparel without a liner. Such apparel also has additional problems over and above wearing the garment with the liner out.

Firefighter's trouser and suspender apparel customarily comprise a set of suspenders and a pair of trousers including an inner liner and an outer shell. The set of suspenders are typically secured to the outer shell by buttons with the inner liner being coupled to the outer shell typically via snaps. Because of the weight associated with multilayer firefighter trousers, suspender buttons often tear off the outer shell due to the stress placed on them by the upward pull of the suspenders. Therefore, it is desirable to have a suspender attachment arrangement which provides better support for firefighter's trousers without substantially increasing the cost of such apparel.

U.S. Pat. No. 261,599 discloses an overall support arrangement wherein three cords, one in front and one in back, are sewn or otherwise secured to the overalls having first had hooks slid over the cords. In use, a set of suspenders including support rings are initially attached to inner trousers with the overalls being supported by engaging the hooks on the cords into the suspender rings. U.S. Pat. No. 278,313 similarly discloses an overall support arrangement wherein straps are used to support overalls from the underlying trousers by engaging a button on the overalls and a suspender button on the trousers. While the aforementioned prior art discloses overall support arrangements, they do not disclose a support arrangement which may be used advantageously with multilayer firefighter's apparel. Nor do they disclose a support arrangement which may be used to indicate whether an inner liner is properly secured within the outer shell of the turnout pants.

Accordingly., there is a need for an improved suspender support arrangement for firefighter's trousers which provides more even support for the inner liner and the outer shell of turnout pants, and which provides a "liner-out" indication if the inner liner is not properly in place. There is also a need for such a support arrangement for firefighter's trousers which does not substantially increase the costs of apparel currently in use by firefighters.

SUMMARY OF THE INVENTION

The improvements of the present invention solve the problems existing in the prior art and meet this need by providing an improved suspender support arrangement for firefighter's trousers. The present invention provides more even support for the inner liner and the outer shell of turnout pants for firefighters. Additionally, the present invention provides a "liner-out" indication if the inner liner is not properly in place. Moreover, the present invention provides a support arrangement for firefighter's trousers which does not substantially increase costs of the apparel. In the currently preferred embodiment of the present invention, first fastener means is secured to the waist area of the inner liner of the turnout pants for readily receiving the loop fasteners of a set of suspenders. Second fastener means is secured to the waist area of the outer shell of the turnout pants. The second fastener means is aligned with and receives the first fastener means such that the set of suspenders support both the inner liner and the outer shell of the turnout pants. The present invention further ensures that the turnout pants include the inner liner since the set of suspenders may not be secured to the turnout pants without first being secured to the inner liner. Thus, a "liner-out" indication is provided by the present invention.

In accordance with one aspect of the present invention, an apparatus for supporting both the removable inner liner and an outer shell of a pair of firefighter's turnout pants from a set of suspenders comprises a first fastener means secured to a waist area of the inner liner of the turnout pants at a plurality of locations therearound for receiving loop fasteners of a set of suspenders. The apparatus further comprises a second fastener means secured to the waist area of the outer shell of the turnout pants at a plurality of locations therearound. The second fastener means are aligned with the first fastener means for receiving the first fastener means such that the set of suspenders supports both the inner liner and the outer shell of the turnout pants at corresponding locations therearound. The apparatus further ensures that the turnout pants include an inner liner since the set of suspenders may not be secured to turnout pants without an inner liner.

In a first embodiment of the present invention, the first fastener means comprise a plurality of suspender buttons secured to a waist area of the inner liner of the turnout pants at a plurality of locations therearound. Loop fasteners of a set of suspenders are secured to the buttons. The second fastener means comprise buttonholes correspondingly sized with the suspender buttons and formed in the waist area of the outer shell of the turnout pants at a plurality of locations therearound. The buttonholes are aligned with the suspender buttons for receiving the suspender buttons such that the set of suspenders supports both the inner liner and the outer shell of the turnout pants.

In a second embodiment of the present invention, the first fastener means comprise a plurality of fastener studs secured to a waist area of the inner liner of the turnout pants at a plurality of locations therearound. Loop fasteners of a set of suspenders are secured to the studs. The second fastener means comprise sockets sized to receive the fastener studs with the sockets being secured to the waist area of the outer shell of the turnout pants at a plurality of locations therearound. The sockets are aligned with the fastener studs for receiving the fastener studs such that the set of suspenders supports both the inner liner and the outer shell of the turnout pants at corresponding locations therearound.

In accordance with another aspect of the present invention, an apparatus for supporting both a removable inner liner and an outer shell of a pair of firefighter's turnout pants from a set of suspenders comprises affixing means for securing a set of suspenders to a waist area of the inner liner of the turnout pants at a plurality of locations therearound. The apparatus further comprises attachment means secured to the waist area of the inner liner and the outer shell of the turnout pants at a plurality of locations therearound for removably attaching the inner liner and outer shell to one another. Once the inner liner and outer shell are attached together, the suspenders support the assembled turnout pants. The apparatus further ensures that the turnout pants include the inner liner since the suspenders cannot be attached to the outer shell without the inner liner. In an embodiment of the present invention, the affixing means comprises thread sewn through the suspenders and the inner liner to secure permanently the suspenders to the inner liner. The attachment means may comprise hook and loop fastener material, snaps or other appropriate fasteners. The attachment means may be commonly positioned with the affixing means.

Additionally, the apparatus of the present invention may include supplemental fastener means secured to corresponding waist areas of the inner liner and the outer shell for supplementally securing the inner liner to the outer shell. Such supplemental fastener means may comprise hook and loop fastener material or alternatively may comprise snap fasteners. The apparatus of the present invention may include fastener means which are colored to indicate visually that the inner liner is secured to the outer shell. Furthermore, the presence of the set of suspenders indicates that the inner liner is not secured properly to the outer shell since the set of suspenders may not be secured to the turnout pants without an inner liner.

It is an object of the present invention to provide an improved suspender support arrangement for firefighter's trousers which provides more even support for the inner liner and the outer shell of the turnout pants; to provide an improved suspender support arrangement for firefighter's trousers which provides more even support for the inner liner and the outer shell of the turnout pants wherein a "liner-out" indication is provided to identify at the earliest point in the firefighter's donning of protective apparel that the inner liner is not properly in place; and, to provide such a support arrangement for firefighter's trousers which does not substantially increase the cost of the apparel.

These and other objects, features and attendant advantages of the present invention will become apparent to those skilled in the art from a reading of the following detailed description of the preferred embodiment and the appended claims.

DETAILED DESCRIPTION OF THE INVENTION

The present invention provides for supporting both a removable inner liner and an outer shell of a pair of firefighter's turnout pants from a set of suspenders. In the currently preferred embodiment, fastener means are secured to the waist area of the inner liner of the turnout pants at a plurality of locations therearound for receiving loop fasteners from a set of suspenders. The first fastener means may comprise suspender buttons or fastener studs. Second fastener means are secured to the waist of the outer shell of the turnout pants disposed at a plurality of locations therearound. The second fastener means are aligned with the first fastener means for receiving the first fastener means such that the set of suspenders supports the inner liner and the outer shell of the turnout pants. The present invention ensures that the turnout pants include an inner liner since the suspenders cannot be secured to the turnout pants without having an inner liner therein. The second fastener means may include button holes correspondingly sized to receive the suspender buttons or alternatively, sockets correspondingly sized to receive the fastener studs.

In an alternate embodiment, the suspenders may be affixed, for example by sewing, to the inner liner.

The firefighter apparatus of the present invention may also include supplemental fastener means secured to the corresponding waist areas of the inner liner and the outer shell for supplementally securing the inner liner and the outer shell together. Such supplemental fastener means may include hook and loop fastener material, snap fasteners or other appropriate fasteners. The first fastener means and the second fastener means may be colored to indicate visually that the inner liner is secured to the outer shell. Thus, after the firefighter has donned only the turnout pants of his/her protective apparel, there is a visual indication as to whether an inner liner is secured properly to the outer shell of the turnout pants. Additionally, at this juncture of the firefighter's donning of protective apparel, the presence of the set of suspenders indicates that the inner liner is secured to the outer shell of the turnout pants. In this way, the present invention provides a "liner-out" indication at the earliest point in the firefighter's donning of protective apparel. Such "liner-out" indication should be quite effective since turnout pants typically cannot be adequately supported without suspenders.

Figure 1:
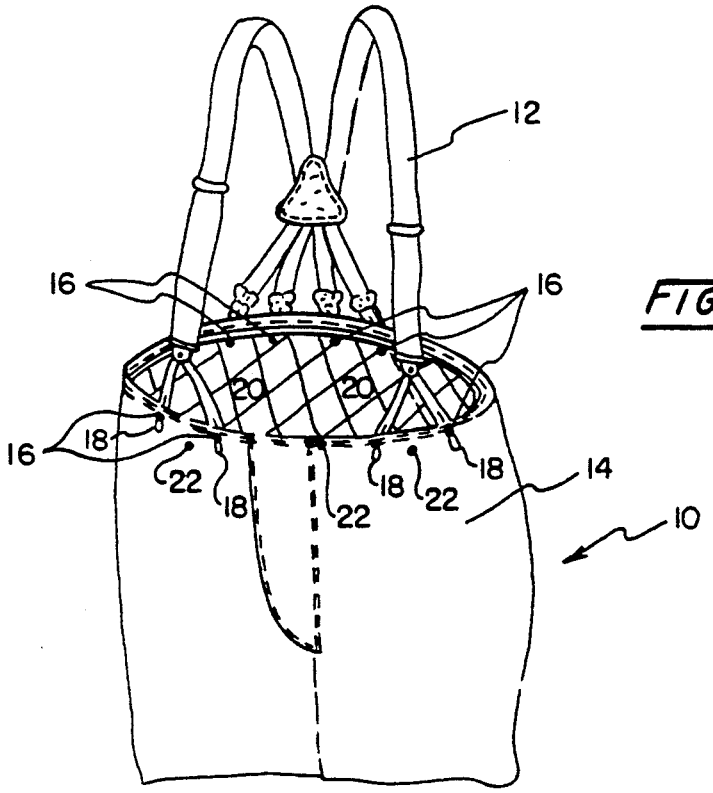
FIG. 1 illustrates the firefighter's turnout pants suspender support arrangement of the present invention.

Referring now to the drawings, and particularly to FIG. 1, a preferred embodiment of the apparatus for supporting firefighter's turnout pants is shown. A pair of turnout pants is generally designated by reference number 10. The firefighter's apparatus is shown to include a set of suspenders 12 secured to the pair of turnout pants 10 by way of first fastener means 16 affixed to the waist area of an inner liner 20 of the turnout pants 10. The turnout pants 10 further include an outer shell 14. Second fastening means 18 are secured to the waist area of the outer shell 14 at a plurality of locations therearound. The second fastener means 18 are aligned with the first fastener means 16 for receiving the first fastener means 16 such that the set of suspenders 12 supports both the inner liner and the outer shell 14 of the turnout pants 10 at a series of locations intermediate the inner liner 20 and outer shell 14. These support positions provide improved support with more equalized and reduced strain.

The firefighter's apparatus further ensures that the turnout pants 10 include the inner liner 20 since the set of suspenders 12 cannot be secured to the outer shell 14 without the inner liner 20. The turnout pants 10 may further include supplemental fastener means 22 secured to the corresponding waist areas of the inner liner 20 and the outer shell 14 for additionally securing the inner liner 20 to the outer shell 14. It will be appreciated by those skilled in the art that the supplemental fastener means 22 is considered an additional feature of the present invention to more evenly secure the inner liner 20 to the outer shell 14.

Figure 2:
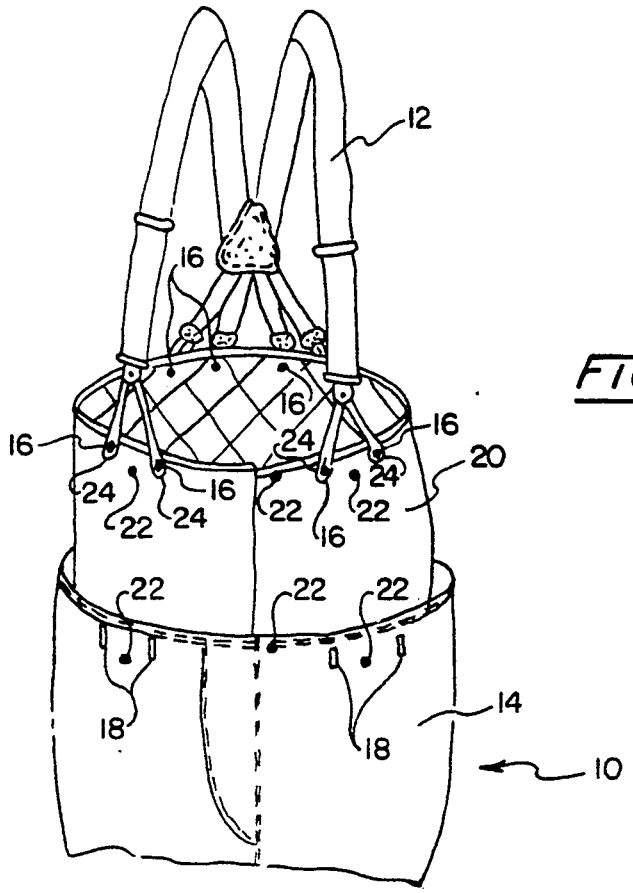
FIG. 2 illustrates the firefighter's turnout pants suspender support arrangement of the present invention having the inner liner of the turnout pants partially removed from the outer shell.

Referring now to FIG. 2, the firefighter's apparatus is shown to have the inner liner 20 partially removed from the outer shell 14. The set of suspenders 12 are shown to include a plurality of loop fasteners 24 which are received by the first fastener means 16. Hence, the set of suspenders 12 must be first secured to the inner liner 20 by way of the loop fasteners 24 and the first fastening means 16 and only thereafter, may the outer shell 14 be secured to the inner liner 20. Accordingly, the set of suspenders 12 may not be secured to the outer shell 14 without first securing the set of suspenders 12 to the inner liner 20 which precludes a firefighter from donning an outer shell 14 without the inner liner 20 properly in place. Thus, the absence of the set of suspenders 12 indicates visually to the firefighter or observer early in the firefighter's donning of protective apparel that the inner liner 20 is not properly in place. As a result, the present invention provides an effective "liner-out" indication before the firefighter dons his/her turnout coat.

The second fastening means 18 of the outer shell 14 are shown in FIG. 2 in a ready position for receiving the first fastening means 16 which have the set of suspenders 12 secured thereto. Furthermore, the supplemental fastening means 22 are shown to be secured to the waist area of the outer shell 14 and the inner liner 20. It should be understood that supplemental fastening means 22 may comprise a plurality of snap fasteners as commonly used in the industry. Alternatively, the supplemental fastening means 22 may comprise any appropriate fastener such as a plastic hook and loop material available from Velcro Industries, Inc. under the trademark Velcro®.

Figure 3:
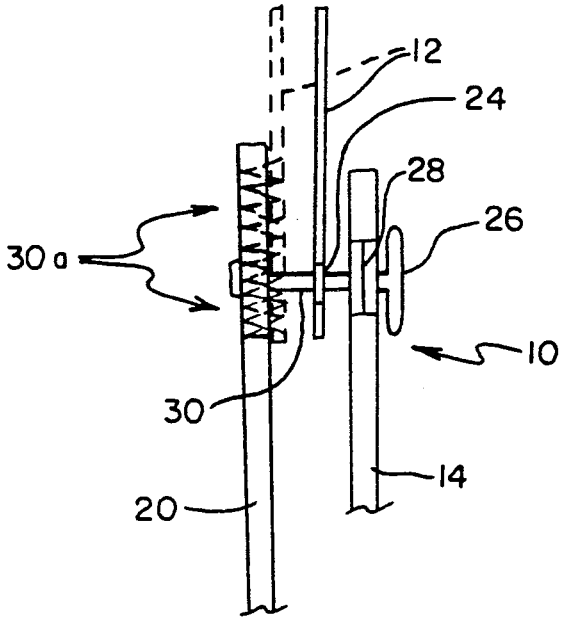
FIG. 3 is a cross-sectional view of the suspender support arrangement and turnout pants of the present invention showing a suspender button and suspender buttonhole.

Referring now to FIG. 3 and continuing with FIGS. 1 and 2, in one embodiment of the present invention, the first fastener means 16 comprises suspender buttons 26 permanently affixed to the inner liner 20. It should be understood that FIG. 3 is a cross-sectional view showing one of the loop fasteners 24. The second fastener means 18 is shown to be a buttonhole 28 correspondingly sized with the suspender button 26. The buttonholes 28 are formed in the waist area of the outer shell 14 of turnout pants 10 at a plurality of locations therearound. The buttonholes 28 are aligned with the suspender buttons 26 for receiving the suspender buttons 26 such that the set of suspenders 12 supports both the inner liner 20 and the outer shell 14 by use of a loop fastener 24 which receives and engages a thread 30 or other filament means which secures the button 26 to the inner liner 20.

The buttonhole 28 is correspondingly sized with the suspender button 26 such that suspender button 26 may readily receive the buttonhole 28. The suspender button 26 may be colored to indicate visually that the inner liner 20 is properly secured to the outer shell 14. Accordingly, the firefighter or an observer may view the apparatus and readily determine whether the suspender buttons 26 are protruding through the outer shell 14 of the turnout pants 10. It is quite apparent to the observer whether the inner liner 20 is properly secured to the outer shell 14, thereby providing a "liner-out" indicator for the firefighter's apparatus.

Figure 4:
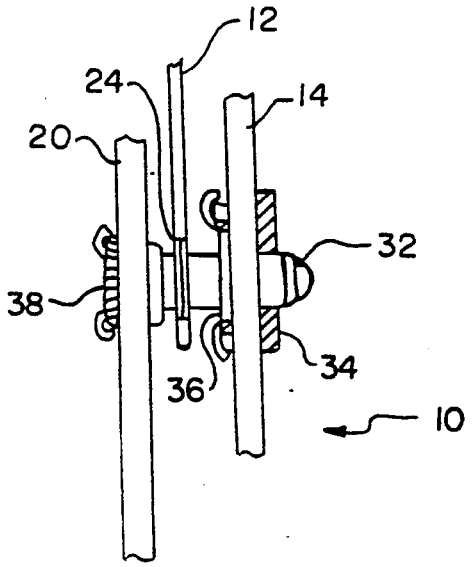
FIG. 4 is a cross-sectional view of the suspender support arrangement and turnout pants of the present invention showing a fastener stud and corresponding socket.

Referring now to FIG. 4 and continuing with FIGS. 1 and 2, in another embodiment of the present invention, the first fastener means 16 comprises fastener studs 32. Again, it should be understood that FIG. 4 is a cross-sectional view showing one of the loop fasteners 24. A plurality of fastener studs 32 are secured to the waist area of the inner liner 20 of the turnout pants 10 at a plurality of locations therearound. The fastener studs 32 project outwardly from the inner liner 20 and readily receive the loop fasteners 24 of a set of suspenders 12. Sockets 34 are sized to receive the fastener studs 32 and the sockets 34 are secured to the waist area of outer shell 14 of the turnout pant 10 at a plurality of locations therearound. The sockets 34 are aligned with the fastener studs 32 for receiving the fastener studs 32 such that the set of suspenders 12 supports both the inner liner 20 and the outer shell 14.

A clinch plate 36 helps secure the socket 34 to the outer shell 14 as shown in FIG. 4. A washer 38 helps secure the fastener stud 32 to the inner liner 20 of the turnout pants 10. The studs 32 used in the present embodiment are commercially available in the industry. The preferred stud 32 is a single, two prong clinch type stud available from the TRW Co., under the trademark Lift-the-Dot ® (Product No. BS 16349). The corresponding washer 38 is preferably obtained from the TRW Co., under the trademark Lift-the-Dot ® (Product No. BS 16501). The sockets 34 used in the present embodiment are also commercially available in the industry. The preferable socket 34 is a long pronged socket sold by the TRW Co. under the trademark Lift-the-Dot ® (Product No. XX 16206) and the corresponding clinch plate 36 is also sold by the TRW Co. under the trademark Lift-the-Dot ® (Product No. BS 16506).

It should be appreciated by those skilled in the art that the stud 32 may have a color distinguishable from the color of the socket 34 and the outer shell 14 such that a firefighter may determine visually whether the inner liner 20 is properly secured to the outer shell 14 of the turnout pants 10. In particular, a firefighter or other observer will be able to view the firefighter when wearing only the turnout pants 10 and determine whether a plurality of the colored studs 32 are protruding through the outer shell 14 around the waist area of the turnout pants 10. If the colored studs 32 are present, then the inner liner 20 is properly in place and the firefighter may then don his/her turnout coat. Accordingly, this aspect of the present invention provides a further "liner-out" indication for the turnout pants 10.

In another embodiment of the present invention, the firefighter's apparatus as shown in FIGS. 1 and 2 may comprise affixing means for securing the suspenders 12 to a waist area of the inner liner 20 of the turnout pants 10 at a plurality of locations therearound. Such locations may be the same as the first fastening means 16 as shown in FIGS. 1 and 2. The affixing means may comprise the first fastening means 16 as described above, but may also comprise any other means for securing the suspenders 12 to the inner liner 20. For example, the suspenders 12 may be sewn to the inner liner 20 using any conventional thread suitable for such sewing purposes as shown in FIG. 3 and 30*a*.

This embodiment further includes attachment means secured to the waist area of the outer shell 14 of the turnout pants 10 at a plurality of locations therearound. The attachment means may comprise the second fastening means 18 in addition to the supplemental fastening means 22 both of which are described above. For example, the attachment means may comprise snaps, the aforementioned plastic hook and loop fastener material or other appropriate removable fasteners and be positioned intermittently around the inner liner 20 and the outer shell 14. The suspenders 12 of this embodiment as with the previous embodiments, support both the inner liner 20 and the outer shell 14 of the turnout pants 14. The firefighter's apparatus further ensures that the turnout pants include the inner liner 20 since the suspenders 12 and the inner liner 20 are sewn together and therefore cannot be secured to the turnout pants 10 without the inner liner 20 being properly in place.

Having described the firefighter turnout pants suspender support arrangement of the present invention in detail and by reference to the preferred embodiments thereof, it will be apparent that modifications and variations are possible without departing from the scope of the invention which is defined in the appended claims.

What is claimed is:

1. Apparatus for supporting both a removable inner liner and an outer shell of a pair of firefighter's turnout pants in combination with a set of suspenders, said apparatus comprising:

fastener studs secured to a waist area of the inner liner of the turnout pants at a plurality of locations therearound for receiving loop-fasteners of said set of suspenders; and sockets sized to receive said fastener studs, said sockets being secured to the waist area of the outer shell of the turnout pants at a plurality of locations therearound, said sockets being aligned with said fastener studs for receiving said fastener studs such that said set of suspenders supports both the inner liner and the outer shell of the turnout pants at a series of corresponding locations intermediate the inner liner and the outer shell, thereby providing equalized support for the inner liner and the outer shell, said apparatus further ensuring that the turnout pants include an inner liner since said set of suspenders cannot be secured to the turnout pants without an inner liner.

2. Apparatus for supporting both the inner liner and outer shell making up a pair of firefighter's turnout pants as claimed in claim 1 wherein said fastener studs and said sockets are colored to visually indicate that said inner liner is secured to said outer shell.

3. Apparatus for supporting both the inner liner and outer shell making up a pair of firefighter's turnout pants as claimed in claim 1 wherein said inner liner includes at least four fastener studs and said outer shell includes at least four correspondingly sized sockets.

4. Apparatus for supporting both a removable inner liner and an outer shell of a pair of firefighter's turnout pants in combination with a set of suspenders, said apparatus comprising:

affixing means for securing said set of suspenders to a waist area of the inner liner of the turnout pants at a plurality of locations therearound; and attachment means secured to the waist area of the outer shell of the turnout pants at a plurality of locations therearound for removably attaching the inner liner and outer shell to one another such that said suspenders support said turnout pants intermediate the inner liner and the outer shell, thereby providing equalized support for the inner liner and the outer shell, said apparatus further ensuring that said turnout pants include the inner liner since said suspenders and said inner liner cannot be secured to said turnout pants without the inner liner.

5. Apparatus for supporting both the inner liner and outer shell making up a pair of firefighter's turnout pants as claimed in claim 4 wherein said affixing means comprises thread sewn through said suspenders and the inner liner.

6. Apparatus for supporting both the inner liner and outer shell making up a pair of firefighter's turnout pants as claimed in claim 5 wherein said attachment means comprises hook and loop fastener material.

7. Apparatus for supporting both a removable inner liner and an outer shell of a pair of firefighter's turnout pants in combination with a set of suspenders, said apparatus comprising:

fastener studs secured to a waist area of the inner liner of the turnout pants at a plurality of locations therearound for receiving loop-fasteners of said set of suspenders; and sockets correspondingly sized with said fastener studs, said sockets being secured to the waist area of the outer shell of the turnout pants at a plurality of locations therearound, said sockets being aligned with said fastener studs for receiving said fastener studs such that said suspenders support both the inner liner and the outer shell of said turnout pants at corresponding locations intermediate the inner liner and the outer shell, thereby providing equalized support for the inner liner and the outer shell, said apparatus further ensuring that said turnout pants include the inner liner since said suspenders cannot be secured to said turnout pants without the inner liner.

8. Apparatus for supporting both a removable inner liner and an outer shell of a pair of firefighter's turnout pants in combination with a set of suspenders, said apparatus comprising:

first fastener means secured to a waist area of the inner liner of the turnout pants at a plurality of locations therearound for receiving loop-fasteners of said set of suspenders; and second fastener means secured to the waist area of the outer shell of the turnout pants at a plurality of locations therearound, said second fastener means being aligned with said first fastener means for receiving said first fastener means such that said suspenders support both the inner liner and the outer shell of said turnout pants at corresponding locations intermediate the inner liner and the outer shell, thereby providing equalized support for the inner liner and the outer shell, said apparatus further ensuring that said turnout pants include the inner liner since said suspenders cannot be secured to said turnout pants without the inner liner, wherein said first fastener means and said second fastener means are colored to indicate visually that said inner liner is secured to said outer shell.

9. Apparatus for supporting both a removable inner liner and an outer shell of a pair of firefighter's turnout pants in combination with a set of suspenders, said apparatus comprising:

at least four fastener studs secured to a waist area of the inner liner of the turnout pants at a plurality of locations therearound for receiving loop-fasteners of said set of suspenders; and at least four correspondingly sized buttonholes secured to the waist area of the outer shell of the turnout pants at a plurality of locations therearound, said at least four buttonholes being aligned with said at least four fastener studs for receiving said at least four fastener studs such that said suspenders support both the inner liner and the outer shell of said turnout pants at corresponding locations intermediate the inner liner and the outer shell, thereby providing equalized support for the inner liner and the outer shell, said apparatus further ensuring that said turnout pants include the inner liner since said suspenders cannot be secured to said turnout pants without the inner liner.

10. Apparatus for supporting both a removable inner liner and an outer shell of a pair of firefighter's turnout pants in combination with a set of suspenders, said apparatus comprising:

suspender buttons secured to a waist area of the inner liner of the turnout pants at a plurality of locations therearound for receiving loop-fasteners of said set of suspenders; and buttonholes correspondingly sized with said suspender buttons, said buttonholes being found in the waist area of the outer shell of the turnout pants at a plurality of locations therearound, said buttonholes being aligned with said suspender buttons for receiving said suspender buttons such that said set of suspenders supports both the inner liner and the outer shell of the turnout pants at corresponding locations intermediate the inner liner and the outer shell, thereby providing equalized support for the inner liner and the outer shell, said apparatus further ensuring that the turnout pants include an inner liner since said set of suspenders cannot be secured to the turnout pants without an inner liner, wherein said suspender buttons and said buttonholes are colored to visually indicate that said inner liner is secured to said outer shell.

11. Apparatus for supporting both a removable inner liner and an outer shell of a pair of firefighter's turnout pants in combination with a set of suspenders, said apparatus comprising:

first fastener means secured to a waist area of the inner liner of the turnout pants at a plurality of locations therearound for receiving loop-fasteners of said set of suspenders;

second fastener means secured to the waist area of the outer shell of the turnout pants at a plurality of locations therearound, said second fastener means being aligned with said first fastener means for receiving said first fastener means such that said suspenders support both the inner liner and the outer shell of said turnout pants at corresponding locations therearound, said apparatus further ensuring that said turnout pants include the inner liner since said suspenders cannot be secured to said turnout pants without the inner liner; and supplemental fastener means secured to corresponding waist areas of said inner liner and said outer shell for additionally securing said inner liner to said outer shell.

12. Apparatus for supporting both the inner liner and outer shell making up a pair of firefighter's turnout pants as claimed in claim 11 wherein said supplemental fastener means comprises hook and loop fastener material.

13. Apparatus for supporting both the inner liner and outer shell making up a pair of firefighter's turnout pants as claimed in claim 11 wherein said supplemental fastener means comprises snap fasteners.

14. Apparatus for supporting both a removable inner liner and an outer shell of a pair of firefighter's turnout pants in combination with a set of suspenders, said apparatus comprising:

suspender buttons secured to a waist area of the inner liner of the turnout pants at a plurality of locations therearound for receiving loop-fasteners of said set of suspenders;

buttonholes correspondingly sized with said suspender buttons, said buttonholes being found in the waist area of the outer shell of the turnout pants at a plurality of locations therearound, said buttonholes being aligned with said suspender buttons for receiving said suspender buttons such that said set of suspenders supports both the inner liner and the outer shell of the turnout pants, said apparatus further ensuring that the turnout pants include an inner liner since said set of suspenders cannot be secured to the turnout pants without an inner liner; and supplemental fastener means secured to corresponding waist areas of said inner liner and said outer shell for additionally securing said inner liner to said outer shell.

15. Apparatus for supporting both the inner liner and outer shell making up a pair of firefighter's turnout pants as claimed in claim 14 wherein said supplemental fastener means comprise hook and loop fastener material.

16. Apparatus for supporting both the inner liner and outer shell making up a pair of firefighter's turnout pants as claimed in claim 14 wherein said supplemental fastener means comprise snap fasteners.

17. Apparatus for supporting both a removable inner liner and an outer shell of a pair of firefighter's turnout pants in combination with a set of suspenders, said apparatus comprising:

fastener studs secured to a waist area of the inner liner of the turnout pants at a plurality of locations therearound for receiving loop-fasteners of said set of suspenders;

sockets sized to receive said fastener studs, said sockets being secured to the waist area of the outer shell of the turnout pants at a plurality of locations therearound, said sockets being aligned with said fastener studs for receiving said fastener studs such that said set of suspenders supports both the inner liner and the outer shell of the turnout pants at corresponding locations therearound, said apparatus further ensuring that the turnout pants include an inner liner since said set of suspenders cannot be secured to the turnout pants without an inner liner; and supplemental fastener means secured to corresponding waist areas of said inner liner and said outer shell for supplementally fastening said inner liner to said outer shell.

18. Apparatus for supporting both the inner liner and outer shell making up a pair of firefighter's turnout pants as claimed in claim 17 wherein said supplemental fastener means comprises hook and loop fastener material.

19. Apparatus for supporting both the inner liner and outer shell making up a pair of firefighter's turnout pants as claimed in claim 17 wherein said supplemental fastener means comprise snap fasteners.

* * * * *